US006702512B1

(12) United States Patent
Reale

(10) Patent No.: US 6,702,512 B1
(45) Date of Patent: Mar. 9, 2004

(54) VEHICLE ARRESTING INSTALLATION

(76) Inventor: George S. Reale, 3444 Marshall Rd., Drexel Hill, PA (US) 19026

( * ) Notice: Subject to any disclaimer, the term of this patent is extended or adjusted under 35 U.S.C. 154(b) by 0 days.

(21) Appl. No.: 10/351,897

(22) Filed: Jan. 27, 2003

(51) Int. Cl.[7] ..... E01F 13/00
(52) U.S. Cl. ..... 404/6; 49/49
(58) Field of Search ..... 404/6; 49/49, 131

(56) References Cited

U.S. PATENT DOCUMENTS

| | | | | |
|---|---|---|---|---|
| 1,203,006 A | * | 10/1916 | Keenan | 49/82.1 |
| 1,563,637 A | * | 12/1925 | Lundblad | 49/49 |
| 2,627,920 A | * | 2/1953 | Barlow | 188/32 |
| 3,667,160 A | * | 6/1972 | Salloum | 49/35 |
| 3,838,783 A | * | 10/1974 | Tune | 414/577 |
| 4,647,246 A | | 3/1987 | Brink et al. | |
| 4,759,655 A | | 7/1988 | Gorlov | |
| 4,998,843 A | * | 3/1991 | Mothe | 404/6 |
| 5,026,203 A | | 6/1991 | Gorlov | |
| 5,248,215 A | * | 9/1993 | Fladung | 404/6 |
| 5,253,950 A | * | 10/1993 | Kilgrow et al. | 404/6 |
| 5,288,164 A | * | 2/1994 | Nasatka | 404/10 |
| 5,507,588 A | * | 4/1996 | Marts et al. | 404/6 |
| 5,549,410 A | | 8/1996 | Beryozkin et al. | |
| 5,704,730 A | | 1/1998 | Burton-Chambers | |
| 5,775,832 A | * | 7/1998 | Kilgrow et al. | 404/6 |
| 5,975,791 A | | 11/1999 | McCulloch | |
| 5,975,792 A | | 11/1999 | Goeken et al. | |
| 6,099,200 A | | 8/2000 | Pepe et al. | |
| 6,158,696 A | * | 12/2000 | Brodskiy | 246/125 |
| 6,241,418 B1 | * | 6/2001 | Suzuki et al. | 404/6 |

FOREIGN PATENT DOCUMENTS

| | | | | |
|---|---|---|---|---|
| GB | 2258676 A | * | 2/1993 | E01F/13/00 |
| GB | 2261454 A | * | 5/1993 | E01F/15/00 |
| WO | WO 90/15901 | * | 12/1990 | E01F/13/00 |

* cited by examiner

*Primary Examiner*—Thomas B. Will
*Assistant Examiner*—Kristine Florio
(74) *Attorney, Agent, or Firm*—Duane Morris LLP

(57) ABSTRACT

A car or other vehicle is prevented from crashing through a barrier along a driveway or other path. One or more bollards stands in the path, on a support in a recessed box that is flush with the surface and defines a pivot axis perpendicular to the path of the vehicle. The bollard can be temporarily detachable to permit passage. A vehicle striking the bollard pivots the bollard backward on the axis, preferably into a clearance space provided. Elongated pike structures are coupled to the bollard and are pivoted up from the surface at an acute angle, to pierce and arrest the vehicle. The pikes can be structural bars, for example of angle iron with flanges formed to barbed points. Preferably several pikes are provided, of which some are angularly fixed relative to the bollard and others are rotatable up to a maximum angle at which the pikes become angularly stopped, for example by engagement with the adjacent pikes. The pikes thus are deployed in a bristling array that engages with the vehicle. The support can have a breakaway attachment with the box, causing the pike array to roll under and progressively to impale the vehicle. This retards the vehicle and precludes effective control by the driver.

18 Claims, 7 Drawing Sheets

VEHICLE ARRESTING INSTALLATION

BACKGROUND OF THE INVENTION

1. Field of the Invention

The invention concerns a barrier for blocking the passage of a vehicle, especially a vehicle attempting to crash through the barrier. The inventive barrier has a bollard post disposed to obstruct a vehicle path. The post is coupled to piercing bars or pikes that are normally kept in a compact stand-by state in a recessed housing bordering the vehicle path. The bars deploy pivotally when the vehicle strikes and pivots back the post. The bars or pikes impale the body of the vehicle and break away in an assembly together with the barrier post, to interfere with controlled or powered driving of the vehicle.

2. Prior Art

It is often desirable to prevent vehicles from passing along predetermined paths. A path may be large enough to admit vehicles or even structured as if intended to admit vehicles, such as a paved lane, but is obstructed due to some traffic control need. In connection with security interests, it may be desirable to prevent vehicles from passing along a path that is normally not intended for vehicle traffic, such as to prevent a vehicle from crashing through a perimeter or guard checkpoint or entrance to a public building.

For security reasons, many government and public buildings such as embassies, consulates, federal courthouses, historical sites and other perceived targets, have been equipped in recent years with barriers comprising heavy closely spaced obstructions such as concrete bollards, planter pots, etc. These barriers are intended to allow pedestrians to pass relatively freely between them, but to present relatively immovable obstructions to a speeding vehicle driven with the intent of crashing through, such as a car or truck containing explosives.

There are many varieties of such obstructions. Among the less aesthetic, large diameter pipes can be embedded part way in the ground or in cast concrete, in turn being filled with concrete to add more mass. Removable or movable arrangements are available that can be retracted into a telescopic base or temporarily lifted out. Solid concrete urn-shaped structures can be used for this purpose. Urns or box-shaped planters can be hollow and filled with soil and plantings for mass.

Certain entrances to spaces such as driveways to pay-parking lots, vehicle-prohibited pedestrian walkways on institutional grounds, generally have less imposing barrier emplacements. Relatively lightweight pipe-bollards, possibly mounted removably, are sufficient protection provided they are visible, because in such instances the operator of the vehicle to be blocked is interested in preventing any damage to the vehicle. In the case of a government building such as an embassy, the vehicle operator may be a suicide bomber. Thus, more substantial barrier structures are often considered appropriate.

One or more obstructions of some form are mounted to obstruct the path, such as a driveway having a width comparable to the width of one or a few vehicles. Two or more obstructions can be spaced laterally across a driveway or other path with lateral sidewall barriers. The obstructions are spaced from one another and from the sidewalls by a distance that is narrower than the width of a typical vehicle to be blocked (e.g., an automobile), while freely admitting pedestrians and perhaps smaller vehicles such as bicycles.

According to some techniques, a shock absorbing mechanism such as a heavy net coupled to tension damped cables can arrest the motion of a vehicle. In another technique, an advancing vehicle can be diverted into a dead-end side spur of one kind or another.

Very massive obstructions are more likely to function effectively as immovable masses to stop a determined attacker or a heavy vehicle than less massive obstructions suitable for lighter vehicles or attacks that are more tentative. Thus, the type and dimensions of an obstruction are dictated by interests such as the gravity of the danger and the size and speed of the expected attack. It is normally undesirable to provide such a substantial barrier that the public building or the like appears heavily fortified. It would be advantageous if public buildings, courthouses, historical sites and the like could appear open and readily accessible to the public. But these are the same sites that seem to be in the greatest danger of terrorist attack. Such sites are sometimes provided with imposing obstructions that are not only forbidding and unaesthetic, but they are expensive. Heavy construction equipment is needed to install or move them. Inadvertent damage (as opposed to deliberate attack) can occur and is expensive to repair. Some form of visually more attractive (or at least less forbidding) obstruction would be desirable, if it achieves comparable protection against attack.

Defensive obstructions against vehicles have been proposed for acute needs such as the entrance driveways for embassies, military checkpoints, border crossings and the like. In U.S. Pat. No. 5,026,203—Gorlov, a movable gate obstruction is provided to pierce laterally into the body of a vehicle advancing along a path, and is movable with advance of the vehicle to divert the vehicle laterally into a dead end siding. For authorized vehicles, the diverting mechanism can be rotated back and clear of the path.

A similar diversion path in U.S. Pat. No. 4,647,246—Brink et al. is arranged such that a trapdoor arrangement can drop away to cause an unauthorized vehicle to be diverted downwardly into a dead end path.

U.S. Pat. No. 5,704,730—Burton-Chambers has a barrier that comprises two pivotally attached members that can open to a maximum angle of 90 degrees. One of the members can be raised to vertical, leaving the other member below the ground surface in a housing box. If a vehicle should drive into the vertical member, the other member pivots up from the box. A ratchet non-return linkage is included. If a vehicle is driven into contact with the vertical member and continues to advance, the front of the vehicle is lifted from the ground. This arrangement seems directed to preventing inadvertent or slow speed advance, as opposed to thwarting an attempt to crash through a barrier.

A security gate that can be rotated to lay flush with the road surface is disclosed in U.S. Pat. No. 5,975,791—McCulloch. This gate has a beam pivoted on a central axis perpendicular to the direction of advance of the vehicle, with clearance underneath to rotate the beam through 360 degrees. The beam has vehicle-piercing points on both opposite ends, aimed in the same direction at right angles to the extension of the beam. The beam can be pivoted to a stowed-away horizontal position with both points facing downwardly, the upwardly facing side of the beam being flush with the road surface. The beam can be pivoted to a vertical defensive position. One point is then above ground, facing toward an oncoming vehicle. The other point is below ground. An impact with the raised end of the beam rotates the beam on the pivot and brings the other point up under the vehicle.

A gate as in McCulloch is theoretically similar to a tank obstruction in that it presents piercing structures that are intended to engage with the vehicle body to stop the vehicle at the obstruction. If built heavily, such an obstruction should stop a vehicle driven to crash through the barrier. However, determined crash could deform the apparatus and cause the vehicle to roll over the rotating beam even while suffering piercing impacts. It would be advantageous if possible to structure an arresting installation to better engage with a vehicle that is crashed and to use the kinetic energy of the vehicle to improve the extent to which the barrier structure engages with the vehicle while improving the chances that the vehicle will be disabled if crashed into the barrier at relatively high speed.

SUMMARY OF THE INVENTION

It is an object of the invention physically and psychologically to impede and deter crashing vehicle attacks on secured sites such as government buildings, populace areas and other potential terrorist targets.

It is an object to maximize the effective obstruction provided by a vehicle arresting installation. At the same time however, the installation is to interfere only minimally with the passage of authorized traffic and is to avoid adverse aesthetic aspects that often accompany security installations.

It is an aspect of the invention to provide a multi-part obstruction that employs relatively modest bollard post structures in conjunction with formidable vehicle arresting elements. The vehicle arresting elements are not concealed when retracted but preferably are held ready at the road surface. The arresting elements are deployed by the force of an attack, and unfold into a visually imposing array. The array comprises a set of pikes that are durably constructed, for example of angle iron stock. The array of pikes aggressively engages an attacking vehicle by using the force of the vehicle both to deploy the pikes and to achieve engagement as the vehicle drives onto the array.

According to a further object, the obstruction is arranged for defense against a range of attack speeds. For extreme attack speeds, a breakaway mounting permits the array of pikes to engage the attacking vehicle and to break free if the energy of the vehicle is sufficient to disengage the mounting, whereupon the array becomes lodged in and under the vehicle to interfere with the driver's ability to continue to advance or to control the vehicle's path.

The foregoing objects and other objects are met in an installation that obstructs movement of a car or similar vehicle along a path over a surface, such as along a road surface or driveway into a secure site. One or more standing bollards protrudes into the path from a support that can be recessed, flush with the road surface except for the bollard, which optionally is detachable. The support defines a pivot axis perpendicular to the path of the vehicle. If a vehicle strikes the bollard, the bollard pivots backward on the axis. Preferably, a clearance space is provided behind the axis. Elongated pike structures are coupled to the bollard and are pivoted up from the surface at an acute angle, to pierce and arrest the advancing vehicle. The pikes can be angle iron bars with barbed points. Preferably, several pikes are provided, and at least some are rotatable on the axis relative to the bollard, up to a maximum angle at which the pikes are angularly stopped relative to the bollard. The pikes stop at different angles. If a vehicle attempts to crash through the bollard, the piercing pikes are deployed in a bristling pike array that engages with the vehicle. The support can have a breakaway mounting at least for the axis, causing the pike array to roll under and progressively to impale the vehicle. This retards the vehicle and precludes effective control by the driver.

BRIEF DESCRIPTION OF THE DRAWINGS

There are shown in the drawings a number of preferred arrangements that should be construed as exemplary rather than limiting. In the drawings.

FIG. 3 demonstrates the engagement of the piercing structure of the invention with a vehicle that crashes through.

DETAILED DESCRIPTION OF THE PREFERRED EMBODIMENTS

Figure 1:
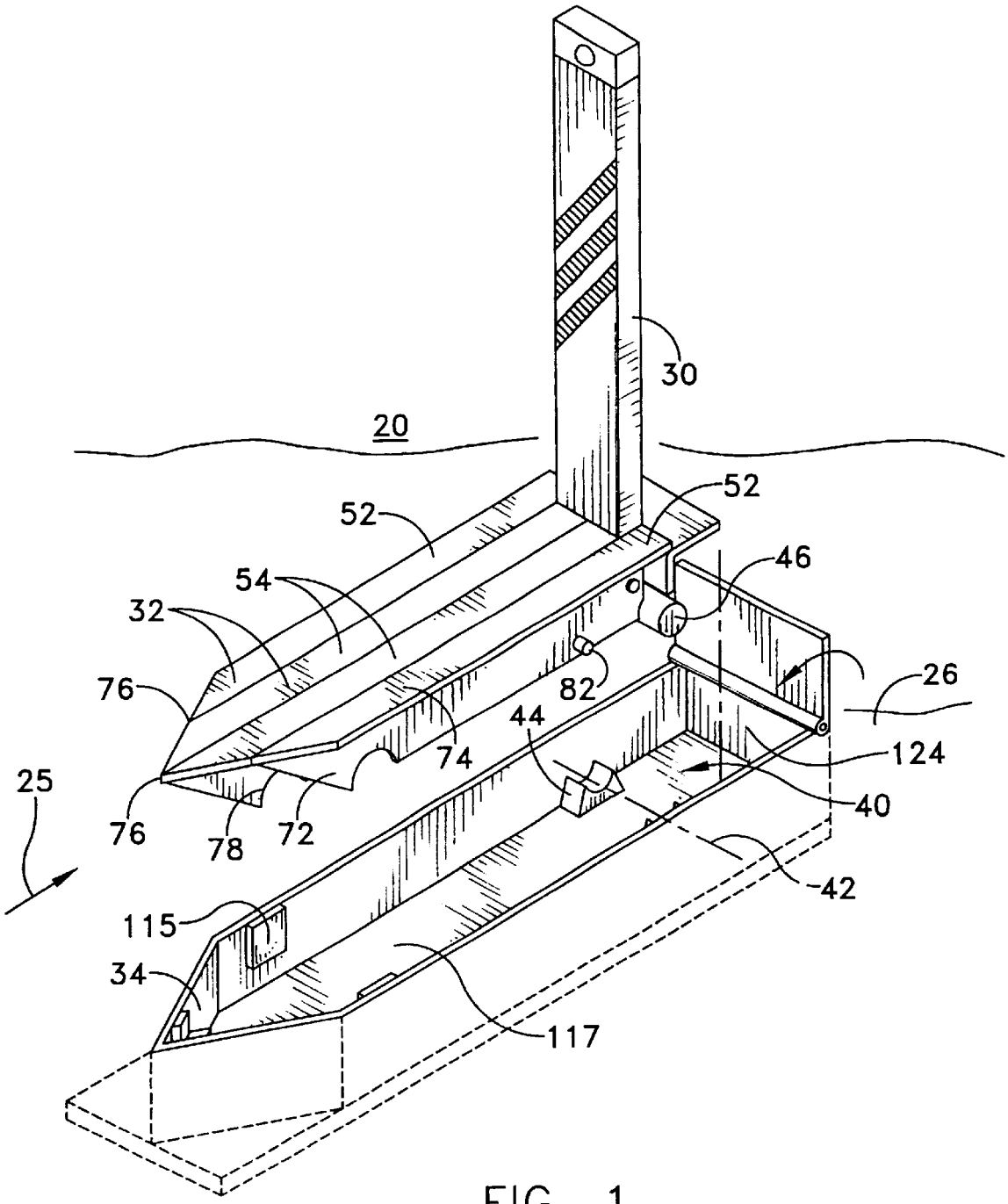
FIG. 1 is an exploded perspective view showing an inventive installation for arresting passage of a vehicle, wherein an assembly is shown above its mounting in a box receptacle recessed whereby portions of the installation lie flush with a surface such as a roadway.

A number of exemplary arrangements of the invention are shown in the drawings. It is an aspect of the invention that an access way of some kind, such as a horizontal roadway or driveway into a secured site, is to be provided with defensive emplacements intended to stop a vehicle. However, the invention is not limited to a particular orientation. Therefore, in this description, terms that denote orientations and absolute or relative directions, such as "up," "down," "above," "below," "vertical," "horizontal," etc., should be construed to refer to the drawing or alternative under discussion. These terms are not intended to limit the subject matter to any particular orientation or relative position, unless so stated or as necessary in view of the operation of the structure being discussed.

Throughout the drawings and this description, the same reference numbers have been used to refer to the same elements in the respective embodiments and in the different views.

The invention provides an installation 20 for arresting movement of a vehicle 22 through a secured station located along a path or course 25 bordered by at least one surface 26 extending along part of the course. The installation 20 generally includes a portion that extends visibly to obstruct the path of the vehicle, and has deployed structures that come into action under the force of impact between the vehicle and the obstruction portions to move into a position at which the vehicle is engaged and impaled. The visible obstruction is described herein as a bollard or bollard post 30. A bollard can take various forms, and for the present application, the bollard 30 can be a solid bar, a squared or cylindrical hollow tube, a filled tube, etc., that stands in the path of the vehicle.

The deployed structures include structural bars shaped as pikes 32 that are raised from the surface 26 to an acute angle from the surface where the pikes 32 are normally disposed in a recessed receptacle box 34, preferably flush with the surface. In the drawings, emphasis is placed on the nature and mechanism of the obstructing part or bollard 30 and the deployed pike-shaped arresting bars 32, shown for example in FIGS. 1 and 2. The illustrations also show particulars of the secured station, e.g., in FIGS. 4 and 5, and a potential manner in which the vehicle 22 can engage the installation 20.

It is an aspect of the invention that the deployed pike structures 32 and the bollard 30 need not be mounted so robustly as to provide a structure having sufficient inherent mass, durability and/or structural connection with the underlying base as to overcome the kinetic energy of a speeding vehicle. Instead, according to an inventive concept, the invention can deploy as a structural unit the bollard 30 and the pike structures 32. After forming an of pike structures 32 at different angles, engaging the vehicle 22, this unit can break free of its mounting. Thus as in FIG. 2, the unit comprising pikes 32 and bollard 30 can operate as a separable device that impales the vehicle 22, especially from underneath, and thereafter is carried along to interfere with the extent to which the driver can continue to advance or can control the path of the vehicle.

With reference to FIG. 1, the installation includes a bollard 30 fixed to a support 40 disposed adjacent to the path or course 25. In FIG. 1, the support 40 includes a receptacle box 34 that has supports positioning the bollard 30 so as to extend from the surface 26 into the path of the vehicle 22 (vertically in this example), and holding the elongated piercing bar structures 32 that normally are retracted but are deployed if a vehicle should strike the bollard 30.

Figure 2:
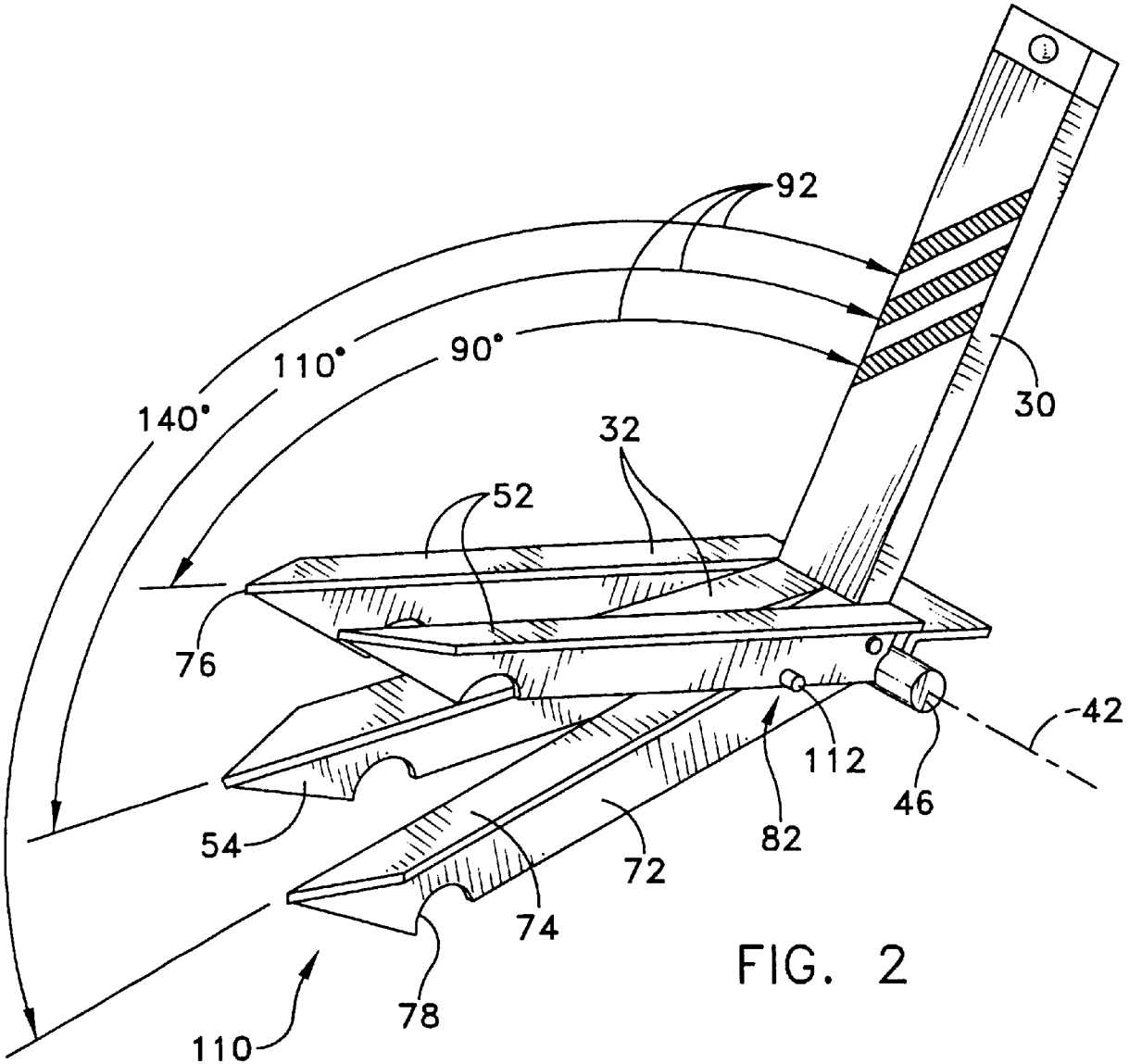
FIG. 2 is a perspective view showing the deployment of piercing structures from the assembly of FIG. 1.
Figure 3:
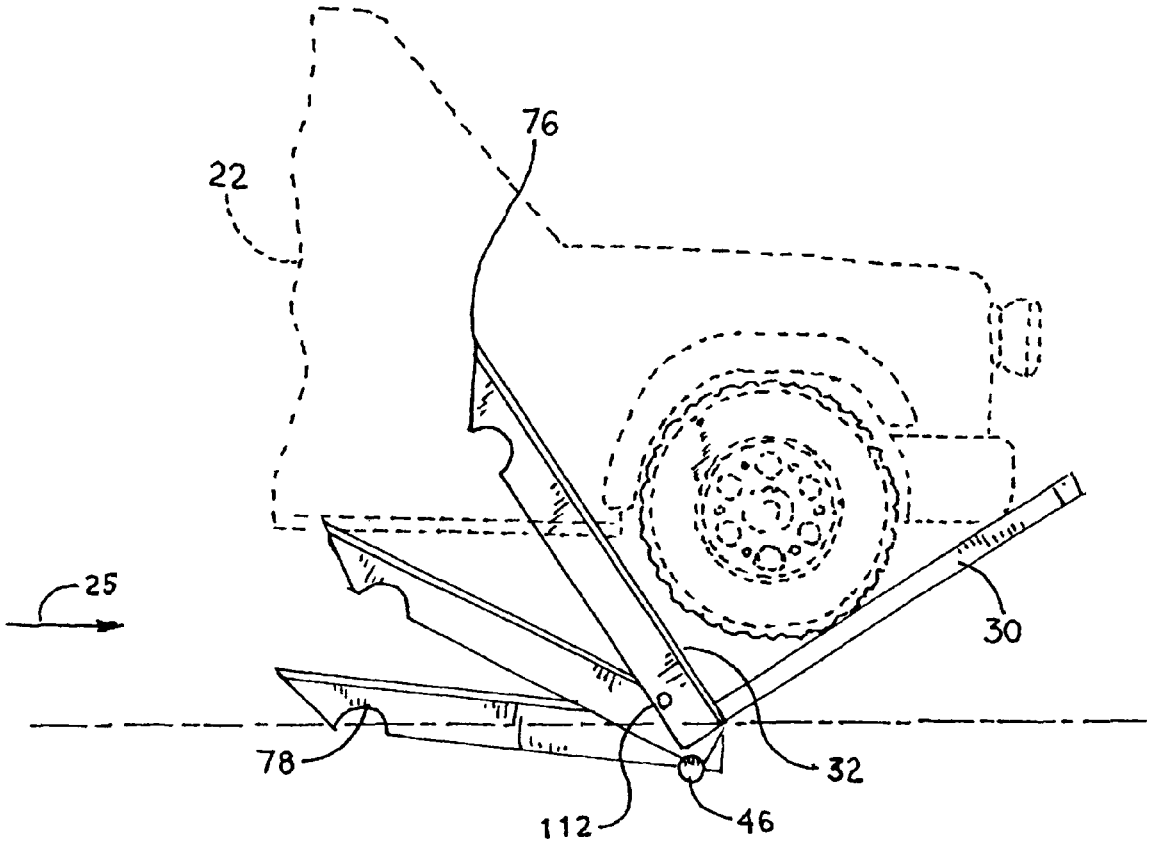

The support 40 is arranged to define a pivot axis 42 for the bollard 30. This axis 42 is oriented to permit the bollard 30 to pivot downward in the direction of advance of the vehicle 22 while causing the piercing structures 32 to be lifted as shown in FIGS. 2 and 3. The axis 42 in FIG. 1 is defined by at least partial pillow blocks 44 disposed in the receptacle box 34, defining the pivoting axis 42 by providing a journal mount for a shaft 46 disposed at or adjacent to a connection between the bollard 30 and the piercing structures or pikes 32. The pivot axis 42 in this example is parallel to the surface 26 and perpendicular to a direction of advance of the vehicle 22 along the course 25.

Also in the illustrated embodiment, the pivot axis 42 is recessed to a point below flush with the surface 26. The pivot axis 42 alternatively could be flush with the surface or could even be higher. However recessing the axis 42 by using a lower mounting for the pillow blocks 44, namely wholly within the box 34, is preferable. Recessing these structures makes it impossible for the attacking vehicle 22 to shear the blocks 44 from their recessed mounting. This could potentially be accomplished on a higher pivot mounting, for example by striking the obstruction at the surface 26 or at least at a low-elevation, for example using a snow plow blade or similar vehicle-mounted device (not shown).

The dimensions of the elements are subject to variations and the axis 42 could be higher or lower than that shown, even when remaining recessed. However, in addition to protecting the supporting structure by recessing it, the respective dimensions affect the leverage applied to lift the piercing structures or pikes 32. The vehicle 22 will normally apply force to the bollard 30 at a point spaced above the axis 42, e.g. at the height of a vehicle bumper, causing rotation of the bollard 30 about the recessed axis 42 and lifting the pikes 32 into position to impale the vehicle.

If the vehicle is traveling at a very high rate of speed, the inertia of levering the pikes up by force against the bollard is not likely to allow the vehicle 22 to shear off the bollard 30 if the axis 42 is low. However but the bollard 30 may become bent. Similarly, if the pikes 32 are moved to a far upright position, then the kinetic energy of the vehicle is applied perpendicular to the extension of the pikes 32 and may bend or shear them. On the other hand, if the axis 42 is near flush with the surface (yet slightly recessed for protection against shearing) then the pikes 32 can be set to engage the vehicle at a low acute angle. At a low angle, the pikes 32 are oriented nearly endwise relative to the vehicle and can the vehicle 22 most effectively. If the axis is well below the surface, the bollard is not likely shear off but may bend in the process of lifting the pikes, particularly if the pikes are massive and thus have high inertia.

Although there are possible variations, the installation is preferably arranged with a bollard about 1.5 m in height (about four feet) and piercing pikes that have a range of lengths, including pikes at approximately the same length as the bollard (1.5 m) and also longer pikes (e.g., 2 m). Assuming those lengths, in the example shown the pivot axis is centered about 20 cm below the surface grade.

The pikes 32 can be structured to maximize strength and limit weight. The pikes 32 are lifted into position, and pierce and damage the vehicle, both by virtue of the kinetic energy of the vehicle itself.

The pikes 32 are elongated piercing structures, are disposed normally flush along the surface 26, and are elongated from the pivot axis 42 in a direction opposite to the path of the vehicle 22. According to one inventive aspect, the piercing structures or pikes 32 generally are mounted to maintain a relative angle with the bollard 30, so that pushing back the bollard 30 raises the pikes. Certain of the piercing pikes 32 are pikes 52 that are rigidly fixed at an angle relative to the bollard 30, especially at a right angle. These angularly fixed pikes 52 can also be fixed at other angles, such as higher angles on the order of 90 to 120 degrees, whereby the pikes are directed acutely downwardly but the force of the vehicle against the bollard 30 rotates the fixed angle pikes, up to engage the vehicle.

Certain other pikes 32 are capable of angular displacement relative to bollard 30. According to the embodiment shown, the arrangement is made compact by providing some angularly fixed pikes 52 (especially fixed at a right angle relative to the bollard 30), and others pikes 54 that are angularly movable from a position substantially flush with surface 26 and parallel to the angularly fixed pikes 52. Movable pikes 54 are angularly displaced relative to bollard 30, up to a maximum angle at which the movable pikes 54 become fixed. In this way, the movable pikes 54 are picked up in turn as the bollard 30 is laid over, opening into a bristling array.

Referring to FIGS. 2 and 3, a vehicle 22 moving along the course to the point of striking the bollard 30, lifts the piercing pike bar structures 32 to an acute angle relative to the surface 26. This can pierce and may completely arrest the vehicle 22, if the bollard 30 and pikes 32 remain fixed on the support 40 that initially fixes the position of the pivot axis 42. On the other hand, the unit comprising bollard 30 and pikes 32 may break free by the force of impact of the vehicle. In that event, it is important to have a structure that interferes with further advance of the vehicle.

Figure 4:
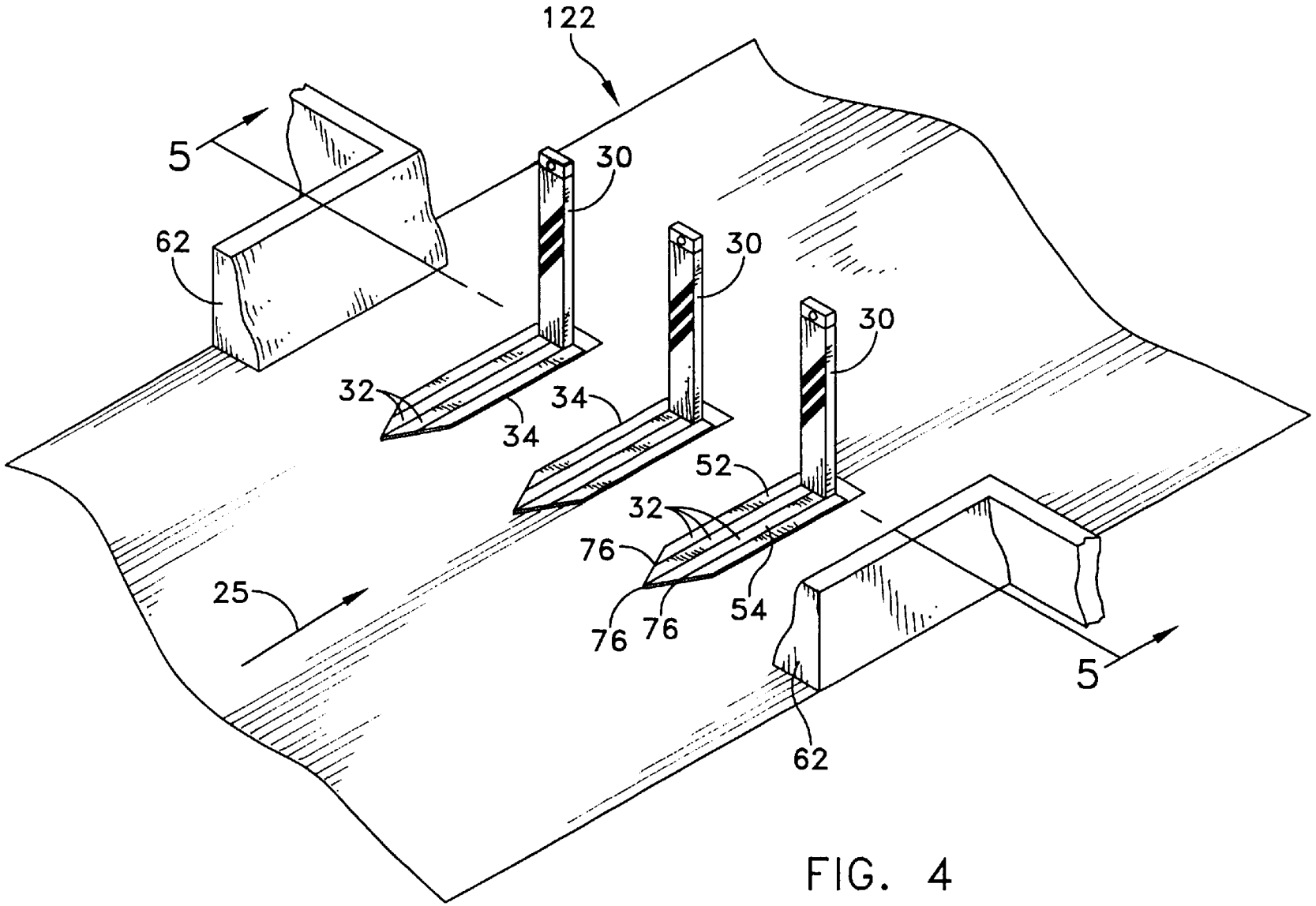
FIG. 4 is a perspective view showing a group of vehicle arresting devices placed to form a roadway barrier.

In FIG. 1 and in the alternative shown in FIG. 4, the installation is flush with surface 26, which in this case is a substantially horizontal surface. This is the most typical application for the invention, namely on a surface defining an underlying roadway, lane, driveway, path or the like.

Figure 5:
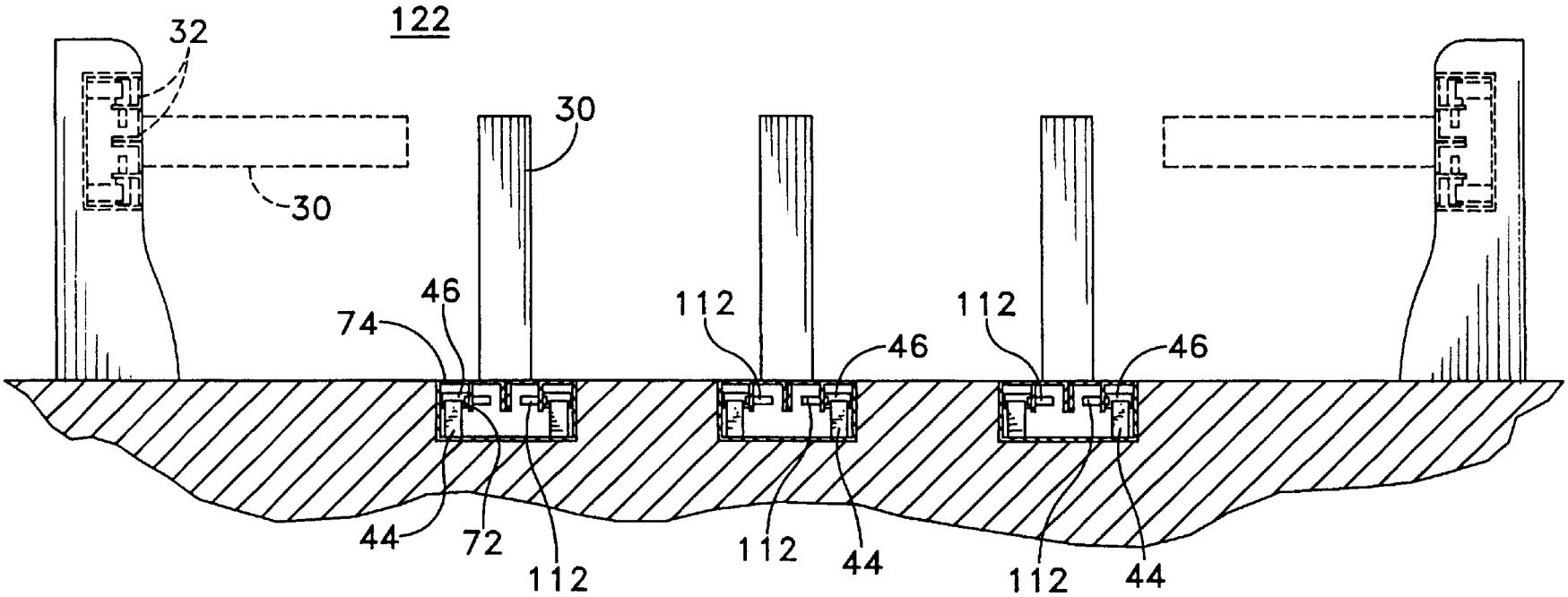
FIG. 5 is an elevation view of an alternative array having bollards at different angles of extension and showing the engagement of associated piercing structures.

Preferably, the surface 26 is arranged with at least passive side barriers 62 such that there is no practical alternative path to be chosen except through the installation. FIG. 5 shows that such side barriers 62 can provide the mounting surface for the invention as arranged to engage the vehicle from the sides. In addition, it is possible to employ a downwardly deployed arrangement (not shown) from an overhead cover such as an arch, spaced from an underlying roadway, or to use a combination of more than one. Preferably, however, at least one, and optionally a laterally spaced array of two or more vertically upward oriented bollards is provided.

In the case of laterally spaced barriers, a New Jersey type tapered side barrier can be provided. Preferably in addition to funneling traffic in the direction of the secured bollard installation, such side barriers include at least a distance immediately preceding the bollards 30, at which an approaching vehicle's vector is substantially perpendicular to the pivot axis. The vector can be somewhat off perpendicular, but the vehicle's inertia is most effectively employed to impale and stop the vehicle, if the approach is at least approximately perpendicular.

In the preferred embodiment, the piercing structure deployed as a result of force against the bollard comprises a plurality of structural bars 52, 54 that pivot up with tilting over of the bollard and are presented at different angles. A plurality of bollards can be placed at positions that are spaced from one another, e.g., horizontally or vertically, or at angularly distinct orientations on respective supports. Advantageously, the bollards are placed at a spacing from one another and from adjacent structures that it is not possible to pass through the protected zone without encountering a bollard. For example, the available lateral spacing is supplied with bollards that are spaced from the adjacent structures and from one another by less than the corresponding width of the smallest vehicle to be stopped.

It is advantageous in a protective installation as described to have a means for permitting traffic to pass when so desired. For this purpose, one or more arrayed bollards 30 can comprise a post that is received in an opening therefore, and removed as known in the art of such bollards. It is also advantageous, however, to prevent unauthorized removal of a bollard, for example by an attacker's accomplice. This can be handled, for example, by a locking arrangement wherein it is necessary to use a key or a combination to open a lock that removably attaches the post or bollard part of the unit to the base portion comprising the pikes that are carried in the receptacle box. Such a locking removable bollard connection is known, for example, from U.S. Pat. No. 6,065,900, which is hereby incorporated.

A preferred form for the piercing pike structures has an L-shaped angle iron cross section, which is strong and light in weight. The pike structures 32 can comprise simple structural angle iron bars having a vertical flange 72 and a horizontal flange 74. For reinforcement, triangular reinforcing plates (not shown) can be welded to the vertical and horizontal flanges in the area between them. It is also possible to use flat stock bars instead of integral flange angle iron, or to have a combination of flat stock bars, cylindrical shafts, tubes of circular, rectangular or other cross section and the like.

In the embodiments shown, each pike of the piercing structure comprises a structural bar 32 having mutually perpendicular flanges 72, 74, one being disposed horizontally and forming a cover flush with the surface 26, and the other extending downwardly.

At least one of the vertical and horizontal flanges 72, 74, and preferably both of them, is tapered to converge to a point 76. Additionally, at least one of the flanges 72, 74 also is shaped into one of a barb 78, serration or similar irregular structure that can resist retraction of the bar 32 after a vehicle has been impaled on the bar. In the depicted example, the vertical flange 72 contains barb 78 and the horizontal flange 74 covers the flush surface.

Referring to FIG. 2, the preferred piercing structure has several structural bars or pikes 32 associated with each of the bollards 30. As discussed, certain of the structural bars 52 are angularly fixed relative to the bollard, especially at a right angle. When ready for deployment the bollard is vertical and the fixed bars are at or below a position flush with the surface. Thus pivoting over the bollard from impact likewise pivots up the angularly fixed bar, the point of the bar engaging the vehicle at a distance rearward of the part contacting the bollard.

In this embodiment, at least one of the structural bars 54 is angularly movable relative to the bollard 30, up to predetermined maximum relative angle. A stop structure 82 fixes the span of relative angular movement of this one 54 of the structural bars at the maximum angle. In FIG. 1, the structural bars all are stowed at the same storage angle, namely flush with the ground surface 26 at 90 degrees relative to the bollard. Therefore, the angularly movable bars have a span between 90 degrees and their maximum angle relative to the bollard. In this case, the maximum angles are about 120 and 140 degrees.

As the bollard is progressively tilted over as shown in FIG. 2, the fixed bars 52 are carried to a progressively higher angle relative to the ground surface 26. During the pivoting upward of the bars 52 that are fixed relative to the bollard 30, the angularly movable bars remain flush with surface 26, until their maximum angular span relative to the bollard 30 is reached. With further pivoting over of the bollard, the movable bars are lifted. The structural bars in this arrangement, as shown in FIG. 2, are deployed to at least two and preferably three different angles 92, and thus form a bristling array 110 of bars or pikes. The different pike angles include pikes at different angles relative to the oncoming vehicle and having points at different positions along the path. In this way, the probability is improved that at least one and preferably several of the bars 32 will impale the vehicle 22 or do substantial damage to the operating components of the vehicle to prevent further advance or at least to cause any further advance to lack effective driver control.

In FIG. 1, the laterally outermost two bars are the angularly fixed bars 52 that are fixed to the bollard at a right angle (or in the case of a removable bollard the outermost bars are fixed to the structure defining a socket to receive the bollard post). Preferably, this involves a rigid connection substantially a right angle with the bollard and can be achieve by bolting the parts together, welding, mortise/tenon engagement, etc. The intermediate bars between the two fixed bars are the angularly movable structural bars 54 that are displaceable to an obtuse angle relative to the bollard, i.e., between 90 and 180 degrees relative to the bollard.

Fixing the movable bars 54 to their obtuse maximum angles can be advantageously accomplished by permitting the movable bars to pivot on the same pivot axis 42 as the bollard 30, but providing an angular stop at which the movable bars engaged the bars that are fixed at 90 degrees relative to the bollard. The structural bars in the embodiment shown have vertical and horizontal flanges 72, 74. At least one of the maximum angles is fixed by a laterally protruding stop pin 112 extending from the vertical flange 72 of one of the structural bars 52 at a space from the axis 42. The stop pin 112 engages under the horizontal flange of an adjacent moveable one 54 of the structural bars that is otherwise pivotable, thereby fixing the maximum angle between those adjacent two bars.

There are alternative ways in which the bars 54 can have fixed maximum angles relative to the bollard 30. For example, each of the bars can encounter an angular stop (not shown) associated with the base adjacent to the journal pivot shaft 46 that carries the bollard 30 or at forms a socket (not shown) for the bollard post, these angular stops defining different angles relative to vertical or horizontal reference angles. A stop pin 112 as described can be mounted on the vertical flange 72 of an adjacent bar that is fixed at 90 degrees relative to the bollard to engage under the horizontal flange of the adjacent bar as in the embodiment shown, or such a pin can be placed to extend under a vertical flange of the adjacent bar.

In the embodiment shown, the bars 32 at the lateral sides of the array rest in the stowed state on shelf forming tabs placed around the inside of the box 34. It is also possible to have a bristling array wherein the bars are all angularly fixed bars 52 relative to the bollard 30. Different relative angles in that case can be achieved by providing a deep receptacle box having clearance below the bottom plate 117 of the depicted box, where such additional bars could normally reside and would be oriented downwardly relative to horizontal until deployed.

The main pivoting axis 42 of the support for the bollard 30 and the bars 32 is defined at least partly by an axle pin or pipe 46 that is rotatably carried on the pillow block 44 as shown in FIG. 1. According to another aspect of the invention, at least one of a connection between the axle pin 46 and the block 44, or a connection between the block 44 and a fixed point such as the receptacle box bottom plate 117 or walls, defines a breakaway connection. The breakaway connection can be similar to that of commonly owned U.S. Pat. No. 6,065,900, which likewise discloses a technique for removably locking a bollard post to a bollard socket for temporarily removing the bollard post when traffic is to pass. The breakaway connection disengages under sufficient impact force from the vehicle, whereupon the piercing structure with the bollard, angularly fixed and angularly movable posts comes free when engaged under the vehicle chassis (or engaged in the body in a side or top mounted arrangement). This structure remains lodged in and carried along by and on or under the vehicle, interfering with mechanical arrangements such as wheel-to-ground contact, steering and the like, impeding or defeating the ability of the driver to continue to advance the vehicle or to control its path.

FIG. 1 shows additional aspects of the preferred box receptacle 34, recessed in the surface 26 of the road or the like, whereby the piercing rods 32 are held flush until the bollard 30 is pivoted over by contact. In the arrangement show, shelf-forming tab elements 115 are provided slightly below the edge of the inside wall surfaces to support the piercing bars. Alternatively, the bars could rest on the box surface.

The bottom plate 117 of the box can protrude beyond the side walls at the point end of the unit as shown. In that case, the bottom plate 117 can form an anchoring structure that is held in place by casting the receptacle box in concrete or paving around the side walls.

FIG. 4 shows a laterally spaced set 122 of bollards as described. The spacing between the bollards and between the endmost bollards and the side walls (such as concrete lane sidewall barriers) is such that a vehicle cannot crash through without encountering at least one of the bollards, and likely two of them. The piercing bars each have a flange disposed parallel to the surface and normally covering over the box receptacle. The piercing bars are visible upon cursory inspection, even if, for example, they are painted to be the color of the pavement. The visible threat provides a deterrent to attack.

The piercing bars lie along the longer extension of the receptacle box, namely oriented counter to the direction of an approaching vehicle along a path leading toward the lateral pivot axis of the bollard. In FIGS. 1 and 4, it is shown that the receptacle box reserves a space 124 on the opposite side of the bollard post. This space provides a clearance area into which the bollard can tilt when struck by a vehicle along the path. This clearance area sufficient to accommodate tilting of the bollard at least up to an angle at which the breakaway connection disengages.

FIG. 5 shows a more extensive and angularly diverse set of bollards, including vertical and horizontal bollards. The horizontal set operates in the same manner as the vertical set, but it is advantageous to use a spring retraction element (not shown) or to mount the device with a slight cant so that gravity keeps the piercing bars retracted until the bollard is struck.

Figure 6:
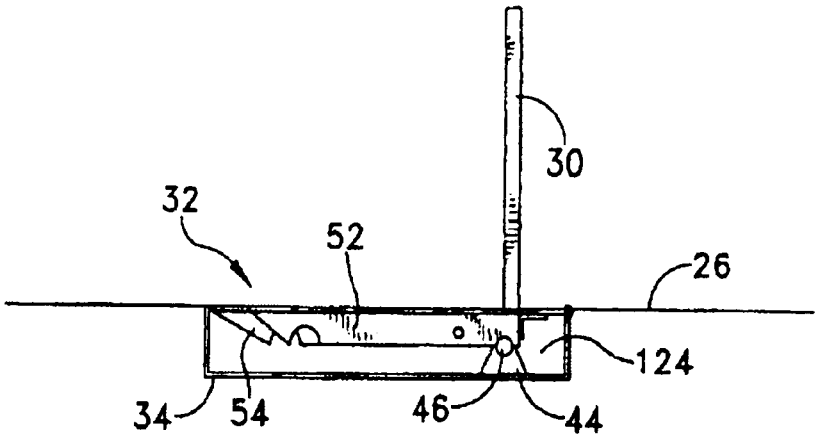
FIGS. 6 through 9 are side elevation views, partly in section, illustrating the progress of impaling and impeding a vehicle attempting to crash through the barrier installation according to the invention.
Figure 7:
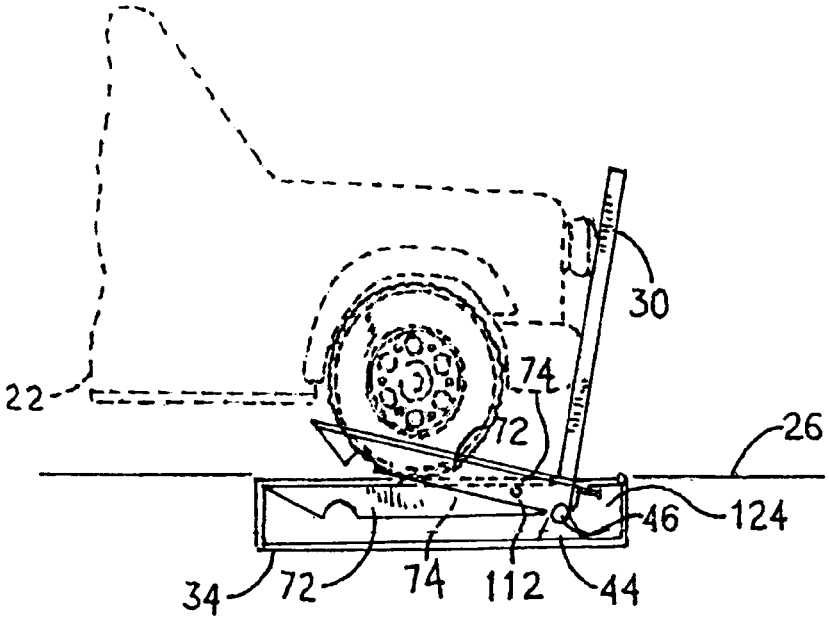
Figure 8:
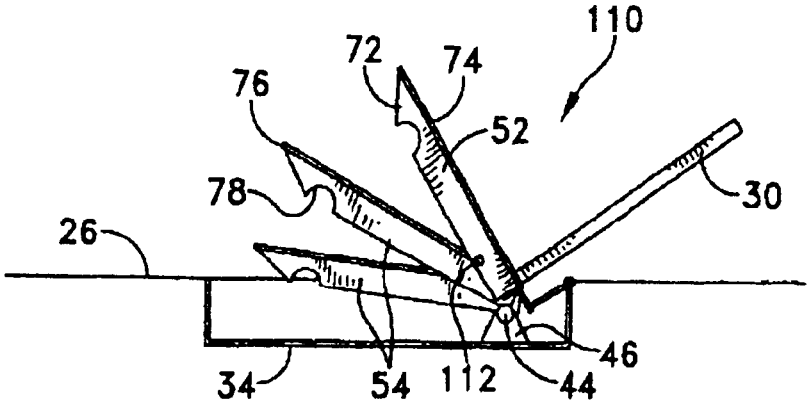

FIGS. 6–9 show the stages of an attempt to crash a vehicle 22 through an installation according to the invention. In FIG. 6, the piercing bars 32 are retracted, but the bollard post occupies the area that a vehicle must pass. As the vehicle strikes the bollard (FIG. 7), the bollard post 30 tilts back on the axis and the piercing bar(s) that are fixed relative to the bollard post likewise tilt upwardly. At some position, the point of the angularly fixed piercing bar 52 encounters the vehicle. Different results will accrue based on what operational part of the vehicle aligns with the piercing bar, which could encounter the engine compartment, a suspension element, the floorboard of the passenger compartment, etc. The piercing bar engages and penetrates or otherwise damages the vehicle.

Unless traveling slowly, the vehicle 22 continues to advance (FIG. 8), whereupon the angularly movable bars 54 encounter their stops 112 and are likewise tilted up to engage the vehicle 22, generally at a point somewhat to the rear of the point of engagement of the angularly higher piercing bars that were deployed first. The vehicle is driven up and onto the assembly of the bollard 30 and piercing bars 32, typically losing sufficient ground contact to continue to operate (i.e., lacking the contact needed to drive forward and to steer the vehicle).

Assuming that the vehicle continues to advance at least due to the kinetic energy of crashing into the device, the bollard post 30 tilts back to contact the edge of the receptacle box 34, occupying the clearance space 124 behind the bollard 30. At this point, the forward force of the vehicle tends to lever the pivot axis pin 42 upwardly relative to the pillow block 44. Apart from upward leverage, the forward inertia of the vehicle, now securely engaged to the assembly of the bollard and piercing bars, also likely exceeds the strength of the attachment between the pivot pin and the pillow block, which is intended to break away at this point. With further advance of the vehicle (FIG. 9), the assembly of the bollard and attached penetrating bars break away from the pillow blocks, remaining lodged in and under the vehicle.

Figure 9:
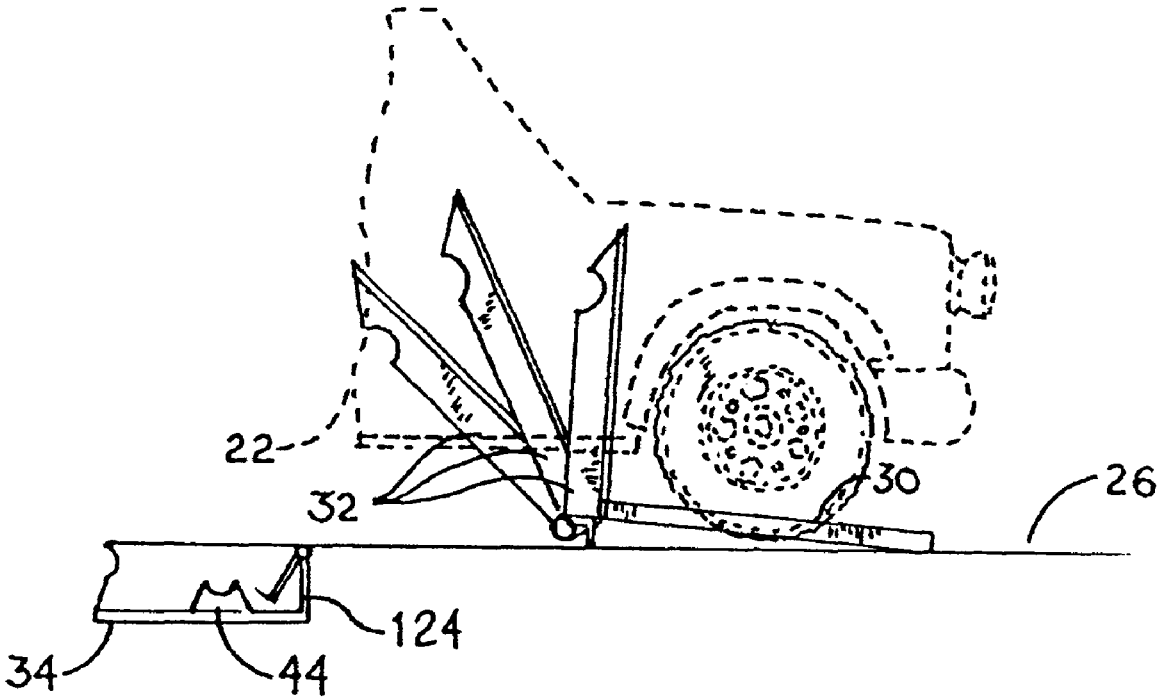

The device is shown intact in FIG. 9. However more typically, there is bending and displacement of the bollard post and piercing bars due to the tendency of the assembly of the post and bars to roll under the vehicle. In any event, the device interferes with continued operation of the vehicle. In addition to mechanical damage caused by the penetrating bars, the device interferes with suspension and steering, by presenting a securely lodged body under and spacing portions of the vehicle from the roadway or from unimpeded contact as needed to steer the vehicle.

A number of variations in specific structures and materials are possible and should now be apparent. The preferred angle-iron form of the bars can be replaced by other solid forms (e.g., I-beam shapes) or tubular elements. The preferred material is steel, but other materials are likewise possible, including combinations such as solid and/or hardened steel piercing points carried on tubing or the like. There are also alternatives for the mechanism that lifts and deploys the bars.

The invention having been disclosed in connection with certain preferred examples, variations employing the inventive aspects will now be apparent. The invention is not limited only to the examples discussed above, and reference should be made to the appended claims instead of the foregoing examples, to assess the scope of the invention in which exclusive rights are claimed.

What is claimed is:

1. An installation for arresting movement of a vehicle along a course bordered by at least one surface extending along part of the course, the installation comprising:

a bollard fixed to a support disposed adjacent to the course, the support defining a pivot axis for the bollard, the axis being oriented substantially parallel to the surface and perpendicular to a direction of advance of the vehicle along the course, the support positioning the bollard such that a free end of the bollard protrudes from the surface into the course and the bollard obstructs a path of the vehicle;

an elongated piercing structure disposed normally along the surface and extending from the axis in a direction opposite to the path of the vehicle, the piercing structure being fixed at a relative angle with the bollard of less than or equal to a predetermined angle, wherein the piercing structure comprises at least one structural bar having flanges and at least one of said flanges is tapered to a point; and, wherein a vehicle moving along the course and striking the bollard lifts the piercing structure to an acute angle relative to the surface, thereby piercing and arresting the vehicle.

2. The installation of claim 1, wherein the surface comprises at least one substantially horizontal surface defining one of an underlying roadway and an overhead cover spaced from an underlying roadway.

3. The installation of claim 1, wherein the surface comprises at least one substantially vertical surface defining a lateral boundary alongside an adjacent roadway.

4. The installation of claim 1, wherein the piercing structure for said bollard comprises a plurality of structural bars that are rotatable over a limited angular span and fixed at different angles relative to the bollard.

5. The installation of claim 1, comprising a plurality of said bollards that are placed at one of laterally spaced positions, vertically spaced positions and angularly distinct orientations on respective said supports.

6. The installation of claim 1, wherein the piercing structure comprises at least one structural bar having at least a vertical flange and a horizontal flange.

7. The installation of claim 1, wherein at least one of said flanges has one of a barb and a serration for resisting retraction of the structural bar following penetration of the vehicle.

8. The installation of claim 1, wherein the piercing structure comprises a vertical flange and a horizontal flange, and wherein both the vertical and horizontal flanges are tapered to a point.

9. An installation for arresting movement of a vehicle along a course bordered by at least one surface extending along part of the course, the installation comprising:

a bollard fixed to a support disposed adjacent to the course, the support defining a pivot axis for the bollard, the axis being oriented substantially parallel to the surface and perpendicular to a direction of advance of the vehicle along the course, the support positioning the bollard such that a free end of the bollard protrudes from the surface into the course and the bollard obstructs a path of the vehicle;

an elongated piercing structure disposed normally along the surface and extending from the axis in a direction opposite to the path of the vehicle, the piercing structure being fixed at a relative angle with the bollard of less than or equal to a predetermined angle, wherein the piercing structure comprises a plurality of structural bars, at least one of the structural bars being angularly movable relative to the bollard, and further comprising a stop structure operable to fix a relative angle of movement of said at least one of the structural bars to a span between a storage angle and the maximum angle; and, wherein a vehicle moving along the course and striking the bollard lifts the piercing structure to an acute angle relative to the surface, thereby piercing and arresting the vehicle.

10. The installation of claim 9, wherein at least one of the structural bars is angularly fixed relative to the bollard and at least one other of the structural bars is movable, the at least one movable structural bar having a storage angle substantially alongside the at least one angularly fixed structural bar.

11. The installation of claim 10, wherein the angularly fixed structural bar defines substantially a right angle with the bollard and the at least one movable structural bar is displaceable to an obtuse angle relative to the structural bar.

12. The installation of claim 11, wherein a plurality of said movable structural bars are provided, having different maximum angles between 90 and 180 degrees relative to the bollard, whereby tilting of the bollard due to striking by the vehicle forms a piercing structure with multiple structural bars directed toward the vehicle at different angles relative to the bollard.

13. The installation of claim 12, wherein the structural bars have horizontal and vertical flanges and wherein at least one of the maximum angles is fixed by a laterally protruding stop pin extending from the vertical flange of one of the structural bars at a space from the axis, said stop pin engaging under the horizontal flange of an adjacent one of the structural bars.

14. The installation of claim 12, wherein said at least one of the structural bars having the stop pin is fixed at 90 degrees relative to the bollard.

15. An installation for arresting movement of a vehicle along a course bordered by at least one surface extending along part of the course, the installation comprising:

a bollard fixed to a support disposed adjacent to the course, the support defining a pivot axis for the bollard, the axis being oriented substantially parallel to the surface and perpendicular to a direction of advance of the vehicle along the course, the support positioning the bollard such that a free end of the bollard protrudes from the surface into the course and the bollard obstructs a path of the vehicle;

an elongated piercing structure disposed normally along the surface and extending from the axis in a direction opposite to the path of the vehicle, the piercing structure being fixed at a relative angle with the bollard of less than or equal to a predetermined angle;

wherein a vehicle moving along the course and striking the bollard lifts the piercing structure to an acute angle relative to the surface, thereby piercing and arresting the vehicle; and, wherein the axis of the support is defined at least partly by an axle pin rotatably carried on a pillow block, and wherein at least one of a connection between the axle pin and the block, and between the block and the course, defines a breakaway connection that disengages under sufficient impact force from the vehicle, whereupon the piercing structure can remain lodged in and carried along by the vehicle.

16. The installation of claim 15, wherein the support is mounted in a box receptacle recessed in the surface.

17. The installation of claim 15, wherein the piercing structure comprises a plurality of structural bars, the bars having at least a flange disposed parallel to the surface and normally covering over the box receptacle.

18. The installation of claim 17, Wherein the box receptacle extends from the bollard in both directions along the path from the pivot axis, wherein the piercing structure extends in a direction from the bollard opposite to the path of the vehicle and wherein the box receptacle defines a clearance area from the bollard along the path of the vehicle sufficient to accommodate tilting of the bollard at least up to an angle at which the breakaway connection disengages.

* * * * *